US005909975A

United States Patent [19]

Kobayashi

[11] Patent Number: 5,909,975

[45] Date of Patent: Jun. 8, 1999

[54] MULTIPLEX WRITING IMPLEMENT

[75] Inventor: Seiichi Kobayashi, Yokohama, Japan

[73] Assignee: Mitsubishi Pencil Kabushiki Kaisha, Tokyo, Japan

[21] Appl. No.: 08/943,074

[22] Filed: Oct. 1, 1997

[30] Foreign Application Priority Data

Dec. 25, 1996 [JP] Japan ..... 8-355822

[51] Int. Cl.[6] ..... B43K 27/00; B43K 7/01; B43K 24/14

[52] U.S. Cl. ..... 401/30; 401/105; 401/116; 401/142; 401/219

[58] Field of Search ..... 401/30, 32, 29, 401/104–106, 141, 142, 219, 116

[56] References Cited

U.S. PATENT DOCUMENTS

| | | | |
|---|---|---|---|
| 3,825,976 | 7/1974 | Moore | 401/104 X |
| 4,272,206 | 6/1981 | Treen | 401/105 |
| 5,655,847 | 8/1997 | Kobayashi et al. | 401/219 |
| 5,709,493 | 1/1998 | Kobayashi et al. | 401/142 X |

FOREIGN PATENT DOCUMENTS

| | | | |
|---|---|---|---|
| 979112 | 4/1951 | France | 401/105 |
| 272588 | 12/1950 | Switzerland | 401/32 |
| 834054 | 5/1960 | United Kingdom | 401/30 |

*Primary Examiner*—David J. Walczak
*Assistant Examiner*—Kathleen J. Prunner
*Attorney, Agent, or Firm*—Darby & Darby

[57] ABSTRACT

The multiplex writing implement includes: a cylindrical portion formed in the rear of the elliptical cylinder portion of the middle barrel; a rotary shaft which is disposed in the bore of the cylindrical portion so as to rotate in a range of about 180° relative to the middle barrel and has a pair of cam grooves in the peripheral surface thereof; and a rear barrel which fits on the outer periphery of the cylindrical portion and is integrally attached to the rear end of the rotary shaft which is projected out from the rear end of the cylindrical portion, and is constructed such that the rear barrel is rotatable relative to the middle barrel; the pair of sliding pieces which respectively have projections on inner sides facing each other, engaging the cam grooves of the rotary shaft are guided inside the bore of the middle barrel so as to only move forwards and backwards; and the sliding pieces can alternately move forwards and backwards following the rotation of the rotary shaft as the rear barrel is rotated.

2 Claims, 6 Drawing Sheets

MULTIPLEX WRITING IMPLEMENT

BACKGROUND OF THE INVENTION (1) Field of the Invention

The present invention relates to a multiplex writing implement having two types of writing elements at least including a ball-point pen element filled up with so-called thixotropic water-soluble (medium viscosity) or low-viscosity oil-based ball-point pen ink, and any other combined one such as a normal oil-based ball-point pen element, mechanical pencil element, etc.

(2) Description of the Prior Art

There is a known writing implement called a multiplex writing implement, which has a plurality of writing elements such as a ball-point pen etc., and which selectively allows one of the elements to come in and out at the front end thereof.

Examples of the mechanisms for projecting and retracting writing tips in multiplex writing implements include a clicking type, a slider type in which sliders exposed to the outside from the side of the barrel cylinder of the writing implement should alternately be slid, a cam type in which a cam cylinder having a slope is rotated to achieve the function, etc.

Since the conventional projecting/retracting mechanisms incorporate return springs for retracting writing elements into the barrel cylinder, it has a complicated structure needing an increased number of parts and resulting in an increased cost.

Since the ink reservoir for a medium viscosity water-soluble or low-viscosity oil-based ball-point pen needs to be of a greater diameter, if it is mounted in a multiplex writing implement of a normal diameter, a sufficiently large margin between the writing elements can not be created and hence the tip parts of the writing elements to be projected can not be guided smoothly to the center of the tip opening of the barrel cylinder. The movement of the writing elements is impeded, and consequently, projection of the tip parts of the writing elements could be hindered. In order to enhance operation, the barrel cylinder should be made very much greater in its diameter, but this degrades its handling performance.

Conventional multiplex implements have a risk that ink will be sucked out and stain clothes if the writing implement is placed in a pocket etc. with its writing point projected out.

Since water-type ball-point pens use an ink which has a low viscosity of a few mPa.S or less, the ball-point pens of this kind offer an advantage that the user does not need to press hard and can write comfortably. Ball-point pens of this kind, however, suffer from some drawbacks, such as the forward leakage phenomenon, the back leakage phenomenon, etc. The former phenomenon causes the ink to ooze out from the writing point, whilst the latter phenomenon is caused by air entering the point assembly via the writing point, inducing the ink to flow out backwards. These phenomena can be prevented by using a piece of fabric called a 'sliver'. On the other hand, if the ball-point pen is left with its cap off, the solvent tends to evaporate because of a high vapor pressure of the solvent. Therefore, there is a concern that the writing point might dry up, causing a lack of ink flow thereby prohibiting writing.

On the other hand, since conventionally known oil-based ball-point pens use an ink having a viscosity of some thousands of mPa.S or more, a considerably large friction arises when the ball rolls and the ink flows out from the writing point, resulting in an uncomfortable writing sensation. Further, at times an insufficient amount of ink flows from the writing point during writing and at others ink blobs, therefore lines drawn may be irregular in parts, the density of the written trace may be light, or a strong pressure for writing may be needed.

As an improvement of the oil-based ball-point pen, recently, a ball-point pen for water-soluble ink which has a viscosity half way between that of the above water-soluble type and the oil type (ranging from a few mPa-S to some thousands of mPa.S), has been developed. This ball-point pen uses water-soluble ink that presents a relatively low viscosity and has so-called thixotropy, which is the characteristic which lowers the viscosity of ink as the tip ball rolls during writing, thus allowing smooth distribution of ink. This type of ball-point pen, however, has the defect that the ink tends to dry up; therefore, it normally needs a cap which is able to seal off the writing tip. Additionally, since the amount of the ink flowing out will increase, it is also necessary to make the ink reservoir greater in diameter to store a larger quantity of ink, in order to increase its writing life.

As an improvement of the oil-based ball-point pen, it is possible to also consider a ball-point pen which uses an oil-based ink which has both a low viscosity and an excellent dryout-resistance. But a ball-point pen of this type, still has the problem that a large amount of ink flows out. Again, in this case, it is necessary to make the ink reservoir greater in diameter to store a greater quantity of ink, in order to increase its writing life. Moreover, since the viscosity of the ink is low, when the tip is placed down and a gap is created between the tip ball and the tip holding portion, ink oozes out (forward leakage) and an excessive amount of ink flows out during writing.

Since the water-soluble ink having a medium viscosity and the low-viscosity oil-based ink both have a relativity low viscosity, this tends to cause back leakage or forward leakage of ink. If the back or forward leakage of ink occurs, the ink may stain clothes etc. Further, another defect may occur in which, due to impacts from being dropped or clicking, ink-starving is likely to occur during writing. Further, the ball-point pen with a medium viscosity water-soluble ink usually has a translucent, nondrying greasy material called a 'follower' added at the rear end of the ink reservoir. Therefore, when trying to prevent ink evaporation, it is adequate to consider the reduction of evaporation of ink from the point assembly, or the gap between the ball and its holder. Therefore, if, for example, a solvent having a considerably low vapor pressure is mainly used as in an oil-based ball-point pen, it is not necessary to consider the evaporation of ink. In the case of the water-soluble ink, however, the main component of the solvent is water; therefore even use of low vapor pressure solvents can not completely prevent water from evaporating.

SUMMARY OF THE INVENTION

It is therefore an object of the present invention to solve the above problems of the prior art, that is, to provide a multiplex writing implement which holds two types of writing elements in its barrel cylinder in a way that allows each of the writing elements to be selectively projected out or retracted at the front end of the barrel cylinder, and which is excellent in handling and still low in its production cost.

In particular, it is an object of the invention to provide a convenient multiplex writing implement having a plurality of writing elements incorporated in its barrel cylinder, at least one of which is a ball-point pen element which uses a medium viscosity water-soluble ink or low-viscosity oil-based ink and is free from forward and back leakage of ink, or has a mechanism to prevent forward leakage and back leakage of ink due to impacts from being dropped or due to upward oriented writing while having at the pen point a resistance to dryout without using any cap, wherein the writing tips can selectively be projected out and retracted into the barrel front and still there is very little risk of staining clothes etc. with the ink.

The present invention has been devised in order to attain the above objects, and the present invention is configured as follows:

In accordance with the first aspect of the invention, a multiplex writing implement having two types of writing elements, one of which is a ball-point pen element comprises: a point assembly which is composed of a tip ball held in a ball holding portion at the tip end thereof and a spring which is arranged so as to constantly bring the tip ball into sealing contact with the inner brim of the ball holding portion and release the sealed state during writing; a non-deformable ink reservoir having a relatively large cross section disposed behind the point assembly and being filled up with a so-called thixotropic, water-soluble ball-point ink or low-viscosity oil-based ink whose viscosity decreases as the tip ball rolls during writing so as to allow smooth distribution of ink; and an ink follower which consists of a translucent, nondrying greasy material and is disposed at the rear end of the ink so as to move in contact with the ink surface following the consumption of the ink, and is constructed such that a barrel cylinder configured of a front barrel and a middle barrel is provided in the form of an elliptical cylinder; the barrel cylinder incorporates a pair of sliding pieces arranged opposite each other in the long-diametric direction of the elliptical cylinder in substantial contact with the inner peripheral wall of the barrel cylinder and a mechanical portion for alternately moving the sliding pieces forwards and backwards; and the writing elements are attached to the front ends of the sliding pieces so that the tip portions of the writing elements will be deflected inwardly and projected out from the tip opening of the barrel cylinder.

Next, in accordance with the second aspect of the invention, the multiplex writing implement having the above first feature, further comprises: a cylindrical portion formed in the rear of the elliptical cylinder portion of the middle barrel; a rotary shaft which is disposed in the bore of the cylindrical portion so as to rotate in a range of about 180° relative to the middle barrel and has a pair of cam grooves in the peripheral surface thereof; and a rear barrel which fits on the outer periphery of the cylindrical portion and is integrally attached to the rear end of the rotary shaft which is projected out from the rear end of the cylindrical portion, and is constructed such that the rear barrel is rotatable relative to the middle barrel; the pair of sliding pieces which respectively have projections on inner sides facing each other, engaging the cam grooves of the rotary shaft are guided inside the bore of the middle barrel so as to only move forwards and backwards; and the sliding pieces can alternately move forwards and backwards following the rotation of the rotary shaft as the rear barrel is rotated.

Further, in accordance with the third aspect of the invention, the multiplex writing implement having the above first feature, further comprises: a cylindrical portion formed in the rear of the elliptical cylinder portion of the middle barrel; a rotary shaft which is disposed in the bore of the cylindrical portion so as to rotate in a range of about 180° relative to the middle barrel and has a pair of projections at the front part on the peripheral surface thereof; and a rear barrel which fits on the outer periphery of the cylindrical portion and is integrally attached to the rear end of the rotary shaft which is projected out from the rear end of the cylindrical portion, and is constructed such that the rear barrel is rotatable relative to the middle barrel; the pair of sliding pieces which respectively have slanted cam grooves on inner sides facing each other, engaging projections of the rotary shaft are guided inside the bore of the middle barrel so as to only move forwards and backwards; and the sliding pieces can alternately move forwards and backwards following the rotation of the rotary shaft as the rear barrel is rotated.

In accordance with the fourth aspect of the invention, the multiplex writing implement having the above second feature is constructed such that the elliptical cylinder portion of the middle barrel and the front part of the rear barrel are formed in the substantially same elliptical cylindrical shape; an edge portion which extends from each side edge of the long-diametric portion at the rear end of the elliptical cylinder portion of the middle barrel is formed; a clip is provided on one side as the short-diametric portion of the rear barrel and has a front end which engages the edge portion of the middle barrel when one of the writing elements is projected out from the tip opening of the barrel cylinder so that the clip cannot be hooked into a pocket or the like and which is positioned at a site in the short-diametric portion at the rear end of the middle barrel when both the writing element tips are accommodated inside the barrel cylinder, so that the clip can be hooked into a pocket or the like.

In accordance with the fifth aspect of the invention, the multiplex writing implement having the above third feature is constructed such that the elliptical cylinder portion of the middle barrel and the front part of the rear barrel are formed in the substantially same elliptical cylindrical shape; an edge portion which extends from each side edge of the long-diametric portion at the rear end of the elliptical cylinder portion of the middle barrel is formed; a clip is provided on one side as the short-diametric portion of the rear barrel and has a front end which engages the edge portion of the middle barrel when one of the writing elements is projected out from the tip opening of the barrel cylinder so that the clip cannot be hooked into a pocket or the like and which is positioned at a site in the short-diametric portion at the rear end of the middle barrel when both the writing element tips are accommodated inside the barrel cylinder, so that the clip can be hooked into a pocket or the like.

DESCRIPTION OF THE PREFERRED EMBODIMENTS

Figure 1:
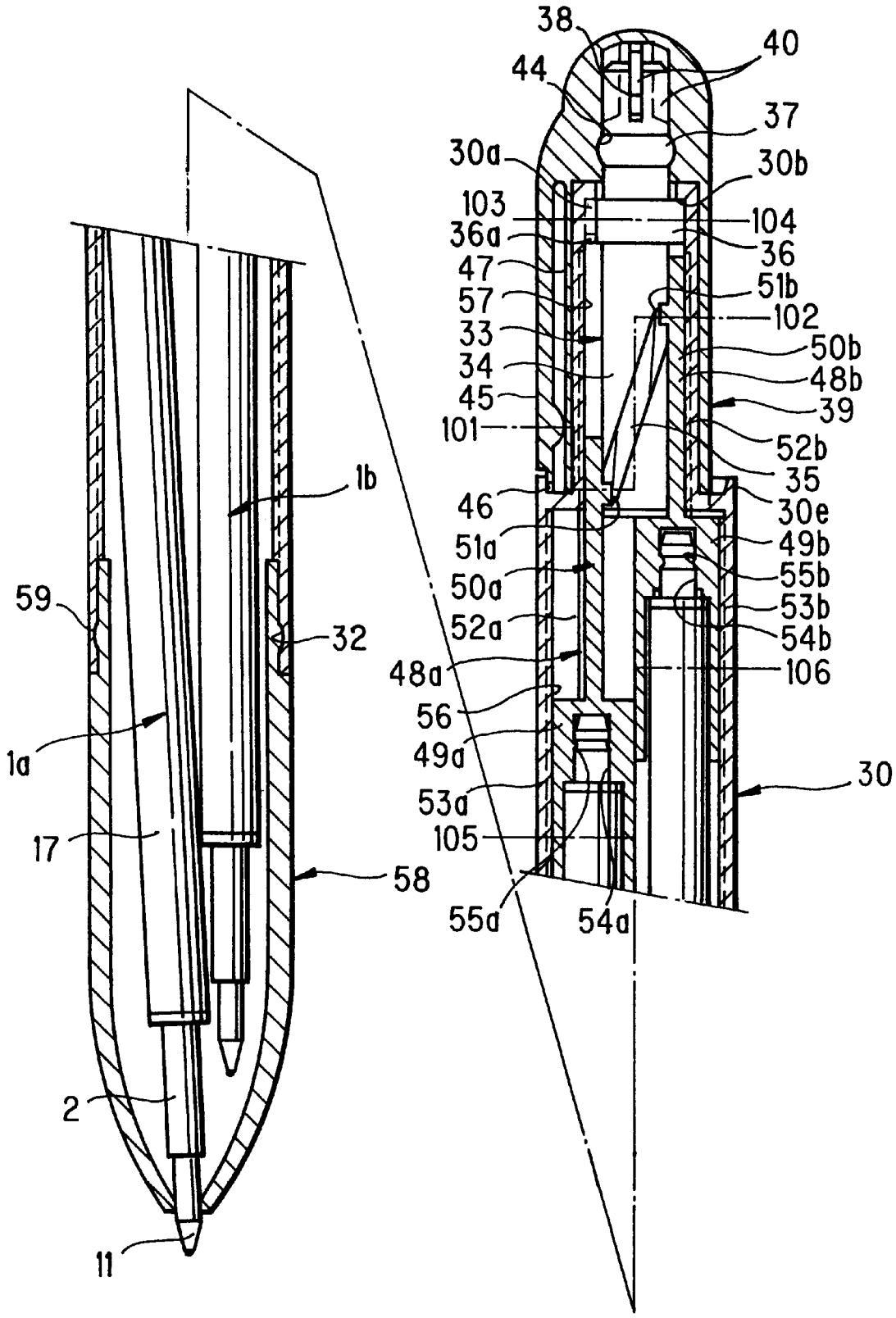
FIG. 1 is a vertical sectional view showing the overall structure of a multiplex writing implement having two types of ball-point pen elements in accordance with embodiment 1 of the invention, where a part of the view is in the non-sectional representation.
Figure 2A:
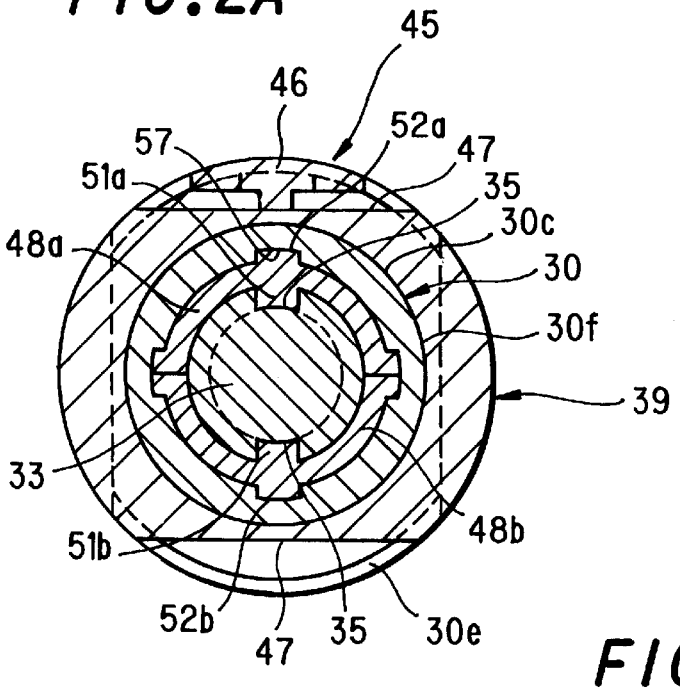
FIG. 2A is a sectional view taken on a line 101-102 in FIG. 1.
Figure 2B:
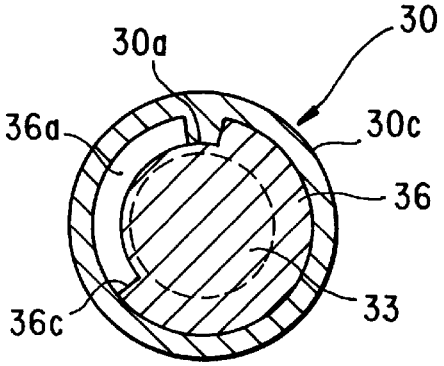
FIG. 2B is a sectional view taken on a line 103-104 in FIG. 1.
Figure 2C:
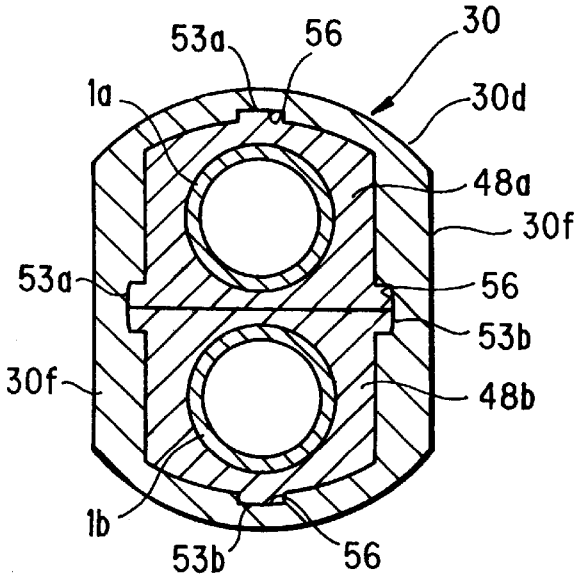
FIG. 2C is a sectional view taken on a line 105-106 in FIG. 1.
Figure 3A:
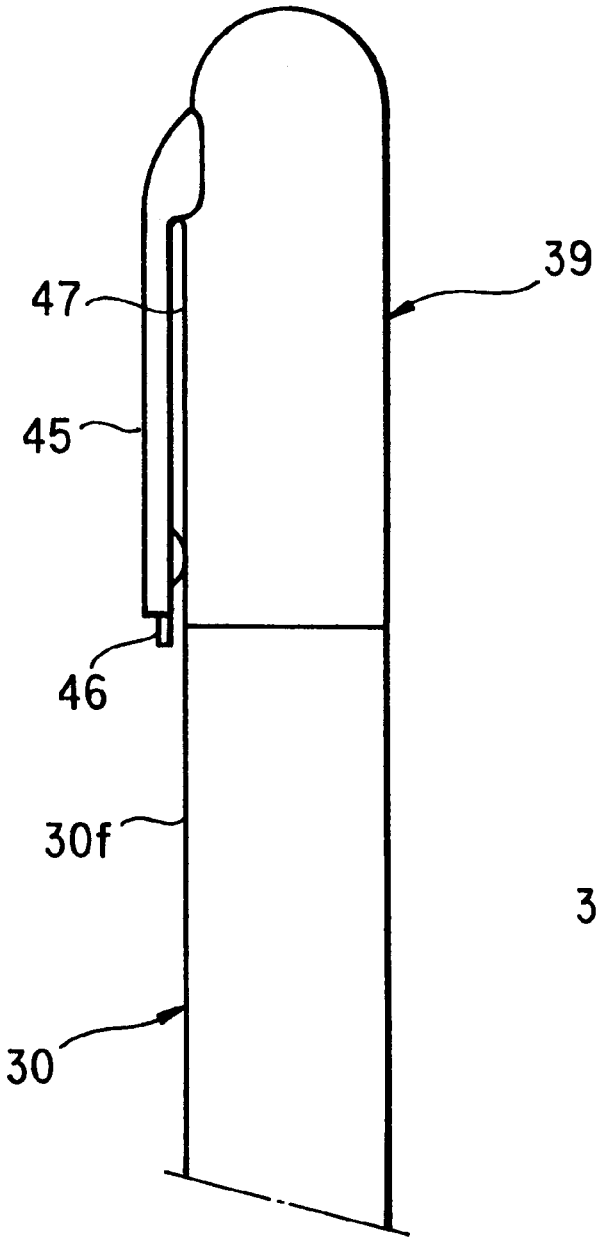
FIGS. 3A and 3B are front and top views showing the appearance of a main part of a multiple writing implement of embodiment 1 of the invention where the writing tips are accommodated in the barrel cylinder.
Figure 3B:
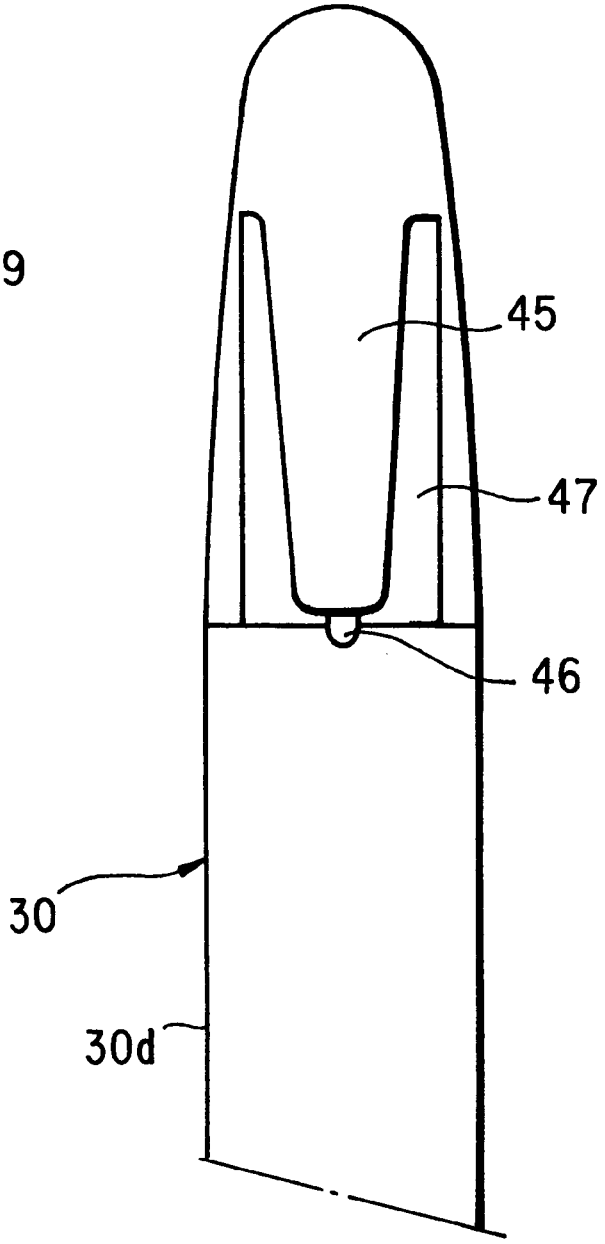

First, FIGS. 1 through 4 show an embodiment 1 of the invention. In FIG. 1, two ball-point pen elements 1*a* and 1*b* are provided.

The multiplex writing implement of the invention at least incorporates a ball-point pen element filled up with so-called thixotropic water-soluble or low-viscosity oil-based ball-point pen ink, and a second one combined as required such as a normal oil-based ball-point pen element, mechanical pencil element, etc.

The multiplex writing implement shown in FIG. 1 comprises front and middle barrels 58 and 30 for accommodating a writing element mechanism and a rear barrel 39 located in the rear of the middle barrel. Formed at the front end of middle barrel 30 and at the rear end of front barrel 58 are engaging portions 32 and 59, which engage each other to integrate the middle and front barrels and are disengaged from each other as required for replacement of writing elements or other purposes. In this invention, a barrel cylinder is composed of front and middle barrels, and in the case where no replacement of writing elements is needed, front and middle barrels are formed as an integrated barrel cylinder.

The rear part of front barrel 58 and the greater part of middle barrel 30 are in the form of an elliptical cylinder. Both sides normal to the short diameter of elliptical cylinder portion 30*d* of the middle barrel are formed of flat portions 30*f* which are substantially flat.

Provided in the rear of elliptical cylinder portion 30*d* is a cylinder portion 30*c*, and an edge portion 30*e* extends from each side edge of the long-diametric portion at the rear end of elliptical cylinder portion 30*d*. A rib 30*a* for limiting the rotational range of an aftermentioned rotary shaft 33 and a stepped portion 30*b* are formed on the inner periphery at the rear end of the bore of cylindrical portion 30*c*, whilst four guide grooves 57 extending in the axial direction, are formed 90° apart on the front inner periphery of cylindrical portion 30*c*. Further, four guide grooves 56 extending in the axial direction, are formed 90° apart on the inner periphery of elliptical cylinder portion 30*d* from its rear to front ends.

Rotary shaft 33 comprises a large-diametric portion 36 with a small-diametric portion 34 at its front part. Formed on the peripheral side of small-diametric portion 34 is a spiral cam groove 35. The rotary shaft further has a cylindrical part having a reduced diameter in the rear of large-diametric portion 36. This cylindrical part has a radially projected engaging portion 37 on the outer periphery in the front part thereof and further has rotation-stopper grooves 38 at desired positions in the rear end thereof. Provided on the peripheral surface of the aforementioned large-diametric portion 36 is a groove 36*a* which is engaged with the aforementioned rib 30*a* to limit the rotation of rotary shaft 33 within a range of, typically, 120° to 180° relative to middle barrel 30 (see FIG. 2B).

Here, when the rotational angle of rotary shaft 33 is made large, the rotational friction will become smaller so that the rotational operation can be performed easily. However, the increase of the rotational angle needs a greater action, which is a drawback in the operation. Accordingly, the rotational range should be selected adaptively; that is, when the diameter of the barrel cylinder is small, the rotational angle may be set at 180° or therearound, whereas when the diameter is large, the rotational angle may be designed to be 120° or therearound.

Sliding piece 48*a* and 48*b* is formed of a front part 49*a*, 49*b* and a rear part 50*a*, 50*b*, and has an insert hole 54*a*, 54*b*, axially formed from the front end of front part 49*a*, 49*b*. Each insert hole has an inwardly projected engaging portion 55*a* and 55*b* for gripping the rear end of ball-point pen element 1*a*, 1*b* (which will be described later). Formed on the inner sides in the rear of rear parts 50*a* and 50*b* are projections 51*a* and 51*b* respectively, which enable respective sliding pieces to move forwards and backwards by the urging force of cam groove 35 as rotary shaft 33 rotates.

Formed on the outer peripheral sides of front parts 49*a* and 49*b* of the sliding pieces are ribs 53*a* and 53*b* as rotation stoppers which engage the aforementioned guide groove 56 formed on the inner periphery of elliptical cylinder portion 30*d* of the middle barrel. Here, the arrangement of the grooves and ribs can be changed.

Formed on the outer peripheral sides of rear parts 50*a* and 50*b* of the sliding pieces are ribs 52*a* and 52*b* as rotation stoppers which engage the guide groove 57 formed on the inner periphery of cylindrical portion 30*c* of the middle barrel. Here, the arrangement of the grooves and ribs can be changed.

Accordingly, ribs formed on the outer periphery of sliding pieces 48*a* and 48*b* mesh corresponding guide grooves formed on the inner periphery of middle barrel 30, whereby sliding pieces 48*a* and 48*b* will smoothly be moved forwards or backwards. Further, there is an advantage that the conventionally used complicated structure which uses a guide cylinder having two opposing guide grooves is not needed.

Then, projections 51*a* and 51*b* of the aforementioned sliding pieces 48*a* and 48*b* are engaged with cam groove 35. In this state, rotary shaft 33 together with the sliding pieces is inserted into the bore of middle barrel 30 in such a manner that the rear end of large-diametric portion 36 is abutted against stepped portion 30*b* of the middle barrel and rear barrel 39 is attached integrally to the rear cylindrical part of rotary shaft 33. Specifically, engaging portion 37 of the rotary shaft becomes engaged with engaging groove 44 in the bore of the rear barrel 39 while rotation-stopper grooves 38 become fitted with rotation-stopper ribs 40 at the rear end of the bore of rear barrel so that rotary shaft 33 and rear barrel 39 will integrally be fixed to one another. In this arrangement, when rear barrel 39 is turned relative to middle barrel 30 and therefore rotary shaft 33 rotates, one of the sliding pieces advances forwards, the other moving backwards. Attached to insert holes 54*a*, 54*b* of sliding pieces 48*a* and 48*b* are the rear ends of ball-point pen element 1*a* and 1*b*, respectively. Further, front barrel 58 is fixed to front of middle barrel 30.

Concerning the attachment of the rear end of a writing element to the insert hole of the sliding piece, the dimension and design of the attachment can be modified as required so that the writing element will sway appropriately, thus making it possible for a writing element which is non-flexible to easily deflect inwardly.

When one of the writing elements is a mechanical pencil, rear barrel 39 needs to axially move relative to middle barrel 30. This can be achieved in design by providing a spring in between which urges them against each other.

Elliptical cylinder portion 30*d* of the middle barrel and the front part of rear barrel 39 are formed in a substantially similar shape, or in an elliptical cylindrical shape, and edge portion 30*e* is extended from the side edge of the long-diametric portion at the rear end of elliptical cylinder portion 30*d*, as already mentioned. A clip 45 is provided on one of flat portions 47 as the short-diametric portion of rear barrel 39. This clip has a small portion 46 at the front end thereof, which engages edge portion 30*e* at the rear end of the middle barrel when one of the writing elements is projected out from the tip opening of the barrel cylinder. This configuration makes it impossible to hook the clip into a pocket etc. On the other hand, when the writing element tips are accommodated inside the barrel cylinder, the front end of clip 45 is positioned at flat portion 30*f* in the short-diametric portion at the rear end of the middle barrel, so that the clip can be hooked into a pocket etc.

Figure 5:
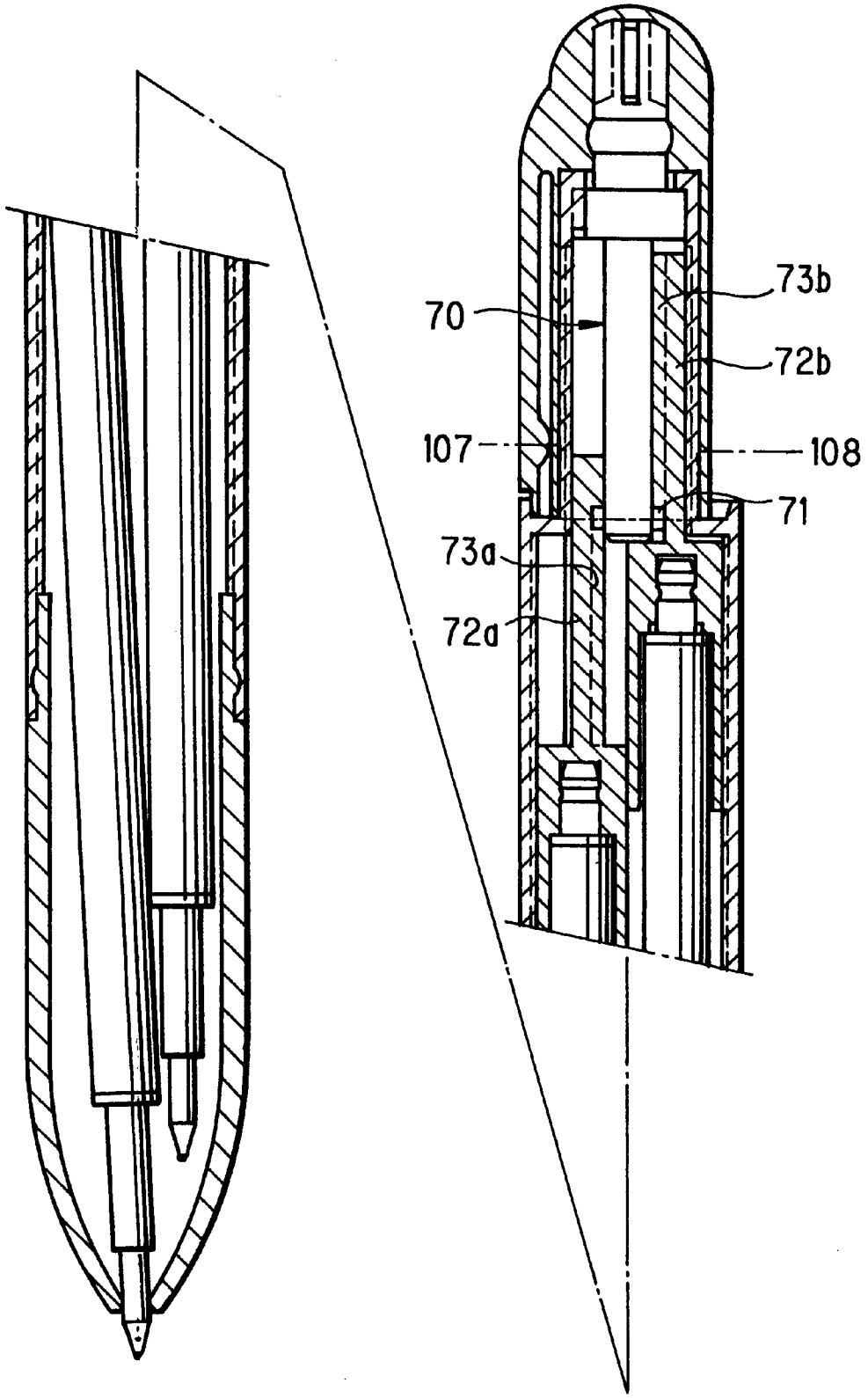
FIG. 5 is a vertical sectional view showing the overall structure of a multiplex writing implement in accordance with embodiment 2 of the invention, where a part of the view is in the non-sectional representation.
Figure 6:
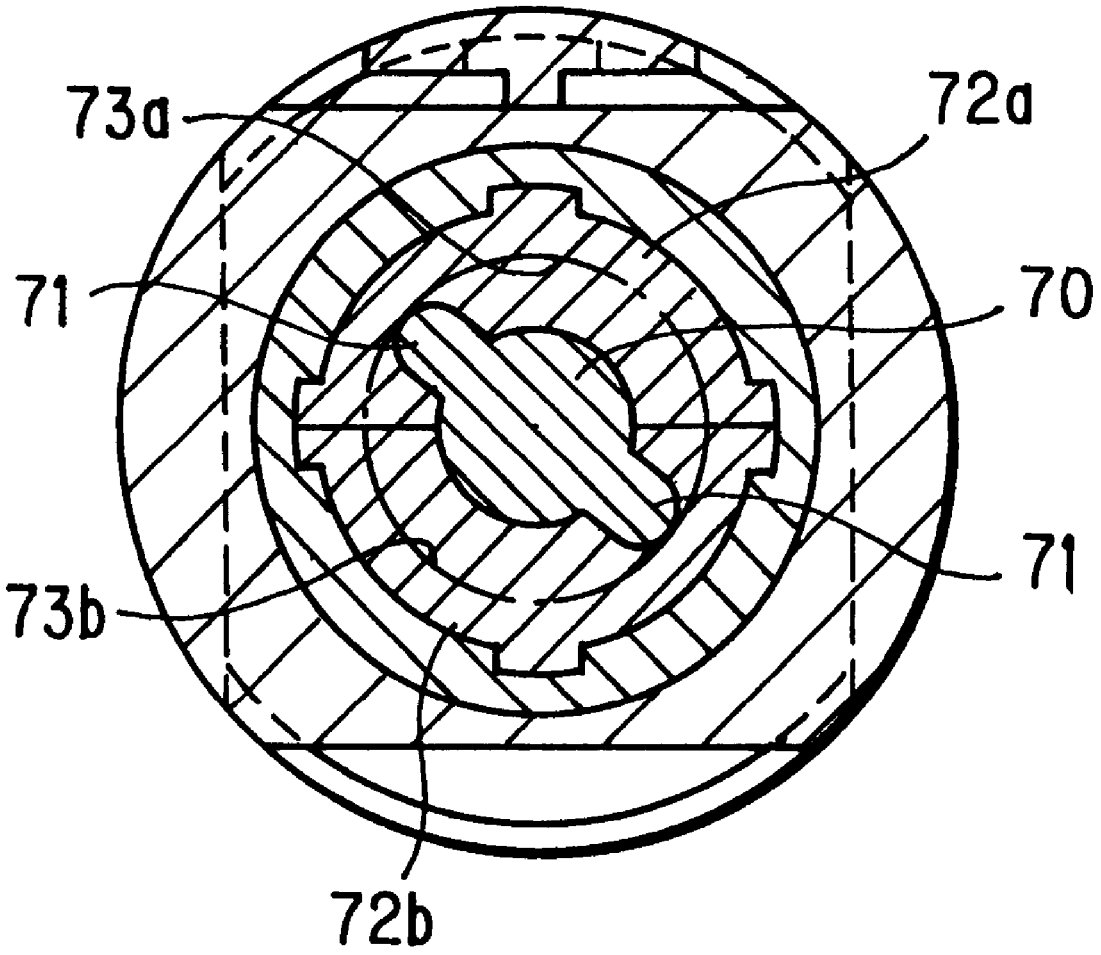
FIG. 6 is a sectional view taken on a line 107-108 in FIG. 5.

FIGS. 5 and 6 show an embodiment 2. Since the basic configuration is almost the same as that of embodiment 1, only the differences will be briefly described.

This configuration includes: a cylindrical portion in the rear of a middle barrel having an elliptical cylinder portion; a rotary shaft 70 which is disposed in the bore of the cylindrical portion so as to rotate in a range of about 180° and has a pair of projections 71 at the front part on the peripheral surface thereof; a rear barrel which fits on the outer periphery of the cylindrical portion and is integrally attached to the rear end portion of the rotary shaft which is projected out from the rear end of the cylindrical portion, the rear barrel being rotatable relative to the middle barrel; a pair of sliding pieces 72*a* and 72*b* which respectively have slanted cam grooves 73*a* and 73*b* on inner sides facing each other, engaging projections 71 of rotary shaft 70 and are guided inside the bore of the middle barrel so as to only move forwards and backwards, wherein the sliding pieces can alternately move forwards and backwards following the rotation of the rotary shaft as the rear barrel is rotated.

Next, a ball-point pen element 1*a* incorporated in the multiplex writing implement of the invention will be described. Here, two ball-point pen elements 1*a* and 1*b* have the same structure, and differ in the color of ink, the width of lines they draw, etc.

The ink used in the ball-point pen element is a so-called thixotropic medium viscosity water-soluble or low-viscosity oil-based ball-point pen ink.

Figure 4:
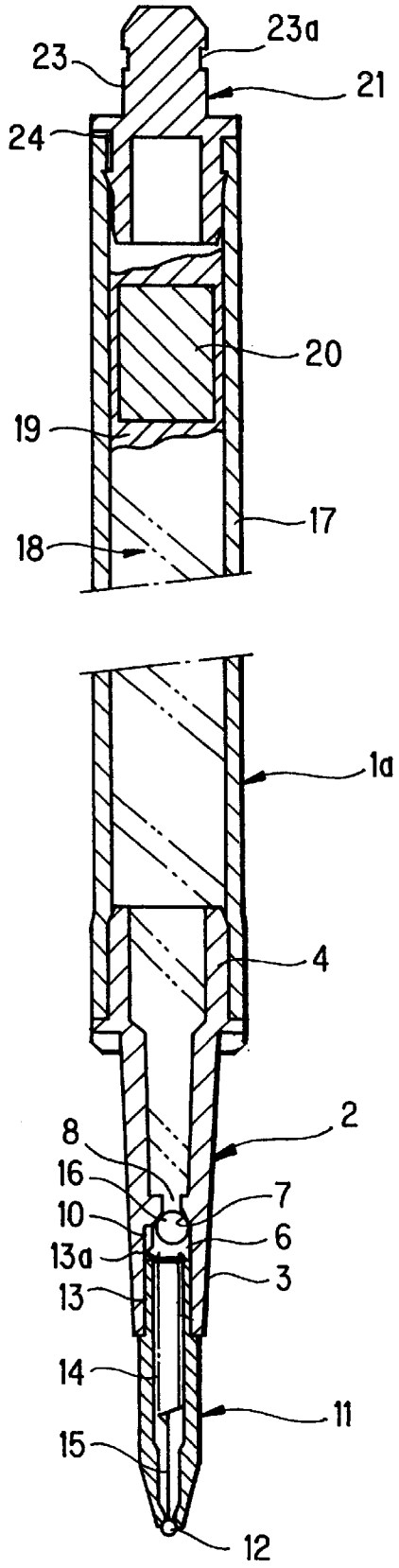
FIG. 4 is a vertical sectional view of a ball-point pen element 1*a*.

As shown in FIG. 4, a point assembly 11 is constructed so that a tip ball 12 is substantially abutted onto a seat having channels which will permit ink to flow in, and is held rotatably by a front press-fitted portion. Further, a spring 14 is inserted into a bore of tip assembly 11. The rear end of a pipe portion 13 of the point assembly is properly press-fitted (by press-fitted portion 13*a*) so that the rear end of spring 14 will not come out. In order to prevent dryout of the writing point and the forward leakage of ink, it is very important to bring tip ball 12 into sealing contact with the inner surface of the ball holding portion. To achieve this, improvements to the surface roughness of the inner surface of the point assembly that holds the tip ball should be considered. A ground finish to the inner surface for improving precision of the sealing contact by press-fitting and the secondary cold-forming process for improving accuracy of press-fitting should also be considered. Further, the surface treatment etc. of the contact surface with the tip ball should be considered.

A straight rod portion 15 is extended forwards from spring 14. The front end of this rod portion 15 abuts the rear side of tip ball 12 to urge it. This pressure causes tip ball 12 to come in sealing contact with the inner brim of the ball holding portion (formed by press-fitting etc.) of point assembly 11.

A joint piece 2 comprises: a front pipe portion 3 at the front end thereof which will be press-fitted to pipe portion 13 of point assembly 11; an rear pipe portion 4 which will be press-fitted to the front end of an ink reservoir 17. Provided in the rear of the bore of front pipe portion 3 is a valve chamber 6 in which a ball valve 16 is placed with play. In the rear of valve chamber 6, a ball seat 7 of a tapered or spherical form and a conduit 8 which is provided appropriately eccentric relative to the axial center, are formed. The bore of rear pipe portion 4 is made to communicate with the bore of ink reservoir 17. A groove 10 which allows ink to flow in the axial direction is formed on one side of the inner wall of valve chamber 6. When point assembly 11 is oriented downwards, this ball valve 16 loosely held inside valve chamber 6 will abut one-sidedly against the rear end of pipe portion 13 of point assembly 11 thereby forming an ink channel. Ink in the ink reservoir flows into the bore of the point assembly through conduit 8, the aforementioned groove and the ink flow passage etc. Conversely, when point assembly is oriented upward, ball valve 16 will abut the ball seat 7 to prevent backward leakage of ink.

Ink reservoir 17 is filled up with an ink 18 for ball-point pens of the aforementioned type. Further, an ink follower 19 consisting of a translucent, nondrying greasy material is added at the rear end of ink 18. This follower will move in contact with the ink surface following the consumption of the ink. In order to prevent deformation due to impacts from being dropped or clicking, a resin-made follower rod 20 having a specific weight substantially equal to that of follower 19 may be immersed in follower 19, as required. A tail plug 21 is fixed to the rear end of ink reservoir 17. Formed in a rear cylindrical part 23 of this tail plug is an engaging groove 23*a* which is detachably caught by engaging portion 55*a* or 55*b* inside the insert hole in the front part of sliding piece 48*a* or 48*b*, respectively. Tail plug 21 further has a ventilation groove 24 which connects the interior of ink reservoir 17 with the outside air.

The aforementioned ink reservoir 17 uses a molding of, for example, transparent PP resin etc., and should be formed from a material that has good clear-drain performance. Further, the ink reservoir may be integrally formed with joint piece 2.

Next, the operation of the multiplex writing implement of the invention thus configured will be described referring to the above embodiments.

First, description will be made of embodiment 1.

When rear barrel 39 is rotated in a specified direction relative to middle barrel 30, the rotation of rotary shaft 33 causes projections 51*a* and 51*b* of sliding pieces 48*a* and 48*b* to slide along cam groove 35 so that one of the sliders moves forwards while the other moves backwards, enabling the writing tip of the writing element which has moved forwards to be projected out from the tip opening of front barrel 58. Although the ink storing portion of the ball-point pen element is non-flexible, the front part of the writing element can flexibly deflect inwardly with respect to the tip opening. Since the front barrel is provided in an elliptical cylindrical form near the tip opening, the writing tip part can, without being impeded, be projected and retracted smoothly from the tip opening of front barrel 58.

When one ball-point pen element 1*a* is projected, the front end of clip 45 is engaged with the edge portion 30*e* so that the clip cannot be hooked into a pocket etc., as shown in FIG. 1.

Next, rotary shaft 33 is rotated so that sliding piece 48*a* moves backwards and the writing tip of ball-point pen element 1*a* is retracted into front barrel 58 while sliding piece 48*b* advances.

In this state, both writing tips are accommodated inside front barrel 58 in a portable state. In this condition, the clip is located at the position shown in FIGS. 3A and 3B, allowing the pen to be readily hooked into a pocket etc.

A further rotation of rotary shaft 33 causes sliding piece 48*a* to move backwards more while sliding piece 48*b* moves further forwards so that the writing tip of ball-point pen element 1*b* projects out from the tip opening of front barrel 58. At that moment, the front end of clip 45 again becomes engaged with edge portion 30*e* of the middle barrel, so that the clip cannot be hooked into a pocket etc. Further, an abutment 36*c* of groove 36*a* formed on large-diametric portion 36 of the rotary shaft shown in FIG. 2B abuts rib 30*a* of the rear barrel so that a further rotation in the same direction will be prohibited.

Concerning ball-point pen element 1*a*, when point assembly 11 is oriented upward, ball valve 16 will be placed on ball seat 7 in valve chamber 6 to seal conduit 8. Therefore, even if the ink right below tip ball 12 in the point assembly is used up during upward oriented writing, any head of pressure which would cause backward leakage, will not be exerted on the ink. Consequently, as soon as point assembly 11 is oriented down again, ink will become able to flow out and thus ink starving during writing can be prevented. In this connection, if a structure without any ball valve is used for upward oriented writing, the weight of ink acts in the direction of backward leakage and draws air into the point assembly. Therefore, when the element is returned to the position of downward writing, ink cannot follow immediately, thereby causing ink starving.

In the writing state where point assembly 11 is oriented downward, ball valve 16 abuts the rear end of point assembly 11 at its one side so that an ink channel through which ink can be flowed into point assembly 11 is assured on the opposite side. In this way, ink 18 which has entered valve chamber 6 from ink reservoir 17 through conduit 8 will be brought to the rearside of tip ball 12.

In this condition, since tip ball 12 is pressed forwards by rod portion 15 so that the ball comes into sealing contact with the inner brim of the ball holding portion, it is possible to prevent forward leakage of ink. When tip ball 12 is slightly moved backwards by the writing pressure, a gap can be created which allows ink to flow out. As tip ball 12 rotates during writing, ink flows out smoothly without causing any blabbing. Thus, it becomes possible to create line traces with thick line density.

Since channels (a plurality of ink flow channels which pass through to the bore of the point assembly are provided on the ball seat of the tip ball) are formed behind tip ball 12, and rod portion 15 is disposed through the central hole around which the channels are formed. Ink inside the point assembly will be brought to the rearside of tip ball 12 through the ink flow channels and the gap between the central hole and rod portion 15.

The operation of embodiment 2 is basically the same and hence the description will be omitted.

Thus, in accordance with the embodiments of the invention, the barrel cylinder is in the form of an elliptical cylinder and hence has a thick appearance, but because the short-diametric portion is gripped during writing, no degradation of use occurs.

The structures, operations and effects of the multiplex writing implements of the invention are configured as has been described heretofore. Therefore, it is possible to provide a multiplex writing implement which has two types writing elements incorporated therein, at least one of which is a ball-point pen element which uses so-called thixotropic water-soluble or low-viscosity oil-based ball-point ink and will not have any backward or forward leakage of ink, still keeps the writing point resistant to dryout without any cap on and can prevent forward leakage of ink and backward leakage of ink due to impacts from being dropped or due to upward oriented writing, and which enables the writing tips of the writing elements to be projected and retracted selectively from the front end of the barrel cylinder, and still has a comfortable thickness of the barrel for handling and writing. Further, there is another advantage that a desk-top ball-pen spare unit of similar type can be used compatibly with the writing element of this multiplex writing implement.

What is claimed is:

1. A multiplex writing implement having two writing elements, each writing element having a tip end, at least one of the two writing elements is a ball point pen writing element comprising:

a front end and a rear end;

a point assembly having a tip ball held in a ball holding portion at the tip end at the front end and a spring arranged to urge the tip ball into sealing contact with an inner rim of the ball holding portion and to release sealing contact with the rim during writing;

a rigid ink reservoir disposed behind and in fluid communication with the point assembly and having a cross-section larger than a cross-section of the point assembly;

a quantity of ink in the ink reservoir supplying the tip ball in the point assembly, the ink selected from the group consisting of a thixotropic, water-soluble ball point ink and a low-viscosity oil-based ink having a viscosity that decreases as the tip ball rolls during writing to allow smooth distribution of ink; and a translucent, non-drying greasy material ink follower disposed at a rearwardly facing surface of the quantity of ink, the ink follower movable in contact with the rearwardly facing surface as the quantity of ink is consumed through the point assembly;

the writing implement further comprising:

a barrel cylinder having a front end and a rear end, the barrel cylinder having a front barrel with a tip opening at the front end, the barrel cylinder having a middle barrel connected to the front barrel, a front portion of the middle barrel having an elliptical cross-sectional shape with a long diameter and a short diameter, a cylindrical rear portion of the middle barrel having a round cross-section and a bore, the barrel cylinder having a rear barrel closely fitted over a rear portion of an outer surface of the cylindrical rear portion of the middle barrel, the rear barrel rotatable relative to the middle barrel;

a forwardly directed rotary shaft integrally attached inside of the rear end of the rear barrel, the rotary shaft disposed in the cylindrical rear portion of the middle barrel such that it is rotatable 180° with respect to the middle barrel in response to rotation of the rear barrel, the rotary shaft having a pair of radially outwardly opening cam grooves;

a pair of sliding members each having a front part supported in the front portion of the middle barrel having the elliptical cross-sectional shape, each front part having a front end; the sliding members arranged opposite to each other such that each is intersected by the long diameter of the elliptical cross-sectional shape, the front part of each sliding member in sliding contact with a corresponding portion of an inner peripheral wall of the front portion of the middle barrel having the elliptical cross-sectional shape, each of the pair of sliding members having a rear part, each rear part of the pair of sliding members having a radially inwardly directed cam projection, each cam projection positioned opposite the other, and each cam projection slidably engaging one of the pair of cam grooves such that the rotation of the rotary shaft in response to rotation of the rear barrel causes the sliding members to alternately move forward and rearward only; and wherein a front portion of the rear barrel has an elliptical cross-sectional shape having a long diameter and a short diameter, the elliptical cross-sectional shape of the front portion of the rear barrel having the same dimensions as the elliptical cross-sectional shape of the front portion of the middle barrel;

an edge portion extends rearwardly from a portion of a side of a rear end of the front portion of the middle barrel, the edge adjacent the long diameter of the elliptical cross-sectional shape of the front portion of the middle barrel;

a clip having a front end is provided on a side of the rear barrel aligned with the short diameter of the elliptical cross-sectional shape of the front portion of the rear barrel, the clip movable from a first position to a second position when the rear barrel is rotated with respect to the middle barrel; in the first position, the clip is aligned with the short diameter of the elliptical cross-sectional shape of the middle barrel and both writing element tips are positioned within the barrel cylinder such that the clip can be hooked into a pocket; and in the second position, the clip is aligned with the long diameter of the elliptical cross-sectional shape of the middle barrel, the tip end of one of the writing elements is projected from the tip opening, and the front end of the clip engages an inwardly directed surface of the edge portion of the rear end of the middle barrel such that the clip cannot be hooked into a pocket; and wherein each of the writing elements is flexibly attached to the front end of one of the pair of sliding members such that the tip end of each of the two writing elements can be selectively deflected radially inwardly and projected from the tip opening of the barrel cylinder.

2. A multiplex writing implement having two writing elements, each writing element having a tip end, at least one of the two writing elements is a ball point pen writing element comprising:

a front end and a rear end;

a point assembly having a tip ball held in a ball holding portion at the tip end at the front end and a spring arranged to urge the tip ball into sealing contact with an inner rim of the ball holding portion and to release sealing contact with the rim during writing;

a rigid ink reservoir disposed behind and in fluid communication with the point assembly and having a cross-section larger than a cross-section of the point assembly;

a quantity of ink in the ink reservoir supplying the tip ball in the point assembly, the ink selected from the group consisting of a thixotropic, water-soluble ball point ink and a low-viscosity oil-based ink having a viscosity that decreases as the tip ball rolls during writing to allow smooth distribution of ink; and a translucent, non-drying greasy material ink follower disposed at a rearwardly facing surface of the quantity of ink, the ink follower movable in contact with the rearwardly facing surface as the quantity of ink is consumed through the point assembly;

the writing implement further comprising:

a barrel cylinder having a front end and a rear end, the barrel cylinder having a front barrel with a tip opening at the front end, the barrel cylinder having a middle barrel connected to the front barrel, a front portion of the middle barrel having an elliptical cross-sectional shape with a long diameter and a short diameter, a cylindrical rear portion of the middle barrel having a round cross-section and a bore, the barrel cylinder having a rear barrel closely fitted over a rear portion of an outer surface of the cylindrical rear portion of the middle barrel, the rear barrel rotatable relative to the middle barrel;

a forwardly directed rotary shaft integrally attached inside of the rear end of the rear barrel, the rotary shaft disposed in the cylindrical rear portion of the middle barrel such that it is rotatable 180° with respect to the middle barrel in response to rotation of the rear barrel, the rotary shaft having a pair of radially outwardly directed cam projections;

a pair of sliding members each having a front part supported in the front portion of the middle barrel having the elliptical cross-sectional shape, each front part having a front end; the sliding members arranged opposite to each other such that each is intersected by the long diameter of the elliptical cross-sectional shape, the front part of each sliding member in sliding contact with a corresponding portion of an inner peripheral wall of the front portion of the middle barrel having the elliptical cross-sectional shape, each of the pair of sliding members having a rear part, each rear part of the pair of sliding members having a radially inwardly opening cam groove, each cam groove positioned opposite the other, and each cam projection slidably engaging one of the pair of cam grooves such that the rotation of the rotary shaft in response to rotation of the rear barrel causes the sliding members to alternately move forward and rearward only; and wherein a front portion of the rear barrel has an elliptical cross-sectional shape having a long diameter and a short diameter, the elliptical cross-sectional shape of the front portion of the rear barrel having the same dimensions as the elliptical cross-sectional shape of the front portion of the middle barrel;

an edge portion extends rearwardly from a portion of a side of a rear end of the front portion of the middle barrel, the edge adjacent the long diameter of the elliptical cross-sectional shape of the front portion of the middle barrel;

a clip having a front end is provided on a side of the rear barrel aligned with the short diameter of the elliptical cross-sectional shape of the front portion of the rear barrel, the clip movable from a first position to a second position when the rear barrel is rotated with respect to the middle barrel; in the first position, the clip is aligned with the short diameter of the elliptical cross-sectional shape of the middle barrel and both writing element tips are positioned within the barrel cylinder such that the clip can be hooked into a pocket; and in the second position, the clip is aligned with the long diameter of the elliptical cross-sectional shape of the middle barrel, the tip end of one of the writing elements is projected from the tip opening, and the front end of the clip engages an inwardly directed surface of the edge portion of the rear end of the middle barrel such that the clip cannot be hooked into a pocket; and wherein each of the writing elements is flexibly attached to the front end of one of the pair of sliding members such that the tip end of each of the two writing elements can be selectively deflected radially inwardly and projected from the tip opening of the barrel cylinder.

* * * * *